US009071025B2

(12) United States Patent
Uozumi et al.

(10) Patent No.: US 9,071,025 B2
(45) Date of Patent: Jun. 30, 2015

(54) SOCKET FOR ELECTRONIC COMPONENTS

(71) Applicant: ALPS ELECTRIC CO., LTD., Tokyo (JP)

(72) Inventors: Takeki Uozumi, Miyagi-Ken (JP); Nobuyuki Okuda, Miyagi-Ken (JP); Shigetomo Chiba, Miyagi-Ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 215 days.

(21) Appl. No.: 13/891,537

(22) Filed: May 10, 2013

(65) Prior Publication Data

US 2013/0323969 A1 Dec. 5, 2013

(30) Foreign Application Priority Data

Jun. 1, 2012 (JP) ..... 2012-125683

(51) Int. Cl.

| | |
|---|---|
| ***H01R 12/00*** | (2006.01) |
| ***H01R 13/659*** | (2011.01) |
| ***H01R 43/00*** | (2006.01) |
| ***H01R 13/6586*** | (2011.01) |

(52) U.S. Cl.

CPC ..... *H01R 13/659* (2013.01); *H01R 43/00* (2013.01); *Y10T 29/49222* (2015.01); *H01R 13/6586* (2013.01)

(58) Field of Classification Search

CPC ..... H01R 23/688
USPC ..... 439/607.1, 607.08, 607.09, 71, 700
See application file for complete search history.

(56) References Cited

U.S. PATENT DOCUMENTS

| | | | | |
|---|---|---|---|---|
| 4,571,014 | A * | 2/1986 | Robin et al. | 439/108 |
| 4,611,867 | A * | 9/1986 | Ichimura et al. | 439/101 |
| 5,201,855 | A * | 4/1993 | Ikola | 439/607.14 |
| 5,620,340 | A * | 4/1997 | Andrews | 439/607.1 |
| 6,203,329 | B1 * | 3/2001 | Johnson et al. | 439/66 |
| 6,471,548 | B2 * | 10/2002 | Bertoncini et al. | 439/607.1 |
| 6,503,108 | B1 * | 1/2003 | Kikuchi et al. | 439/680 |
| 6,527,587 | B1 * | 3/2003 | Ortega et al. | 439/607.05 |
| 6,764,341 | B2 * | 7/2004 | Lappoehn | 439/607.05 |
| 6,808,420 | B2 * | 10/2004 | Whiteman et al. | 439/607.08 |
| 6,808,421 | B2 * | 10/2004 | Okada et al. | 439/607.06 |
| 6,843,686 | B2 * | 1/2005 | Ohnishi et al. | 439/607.12 |
| 6,869,292 | B2 * | 3/2005 | Johnescu et al. | 439/74 |
| 6,877,223 | B2 | 4/2005 | Figueroa et al. | |
| 6,899,566 | B2 * | 5/2005 | Kline et al. | 439/607.56 |

(Continued)

FOREIGN PATENT DOCUMENTS

WO 2011/029428 * 3/2011

*Primary Examiner* — Neil Abrams
(74) *Attorney, Agent, or Firm* — Brinks Gilson & Lione

(57) ABSTRACT

A socket for electronic components includes a shield plate assembly that is formed by combining first shield plates with second shield plates in the form of a lattice and has conductivity, and contact units electrically connected to electrode terminals of electronic components are disposed in openings of the lattice of the shield plate assembly so that the electrode terminals are electrically connected to the wiring of a wiring board. The shield plate assembly is formed in a shape where lines where openings of the lattice are lined up in a first direction are arranged side by side in a second direction orthogonal to the first direction, and the openings of the adjacent lines are formed so as to be shifted relative to the openings of the next lines in the first direction by a half of the length of the side of the opening that extends in the first direction.

4 Claims, 13 Drawing Sheets

(56) References Cited

U.S. PATENT DOCUMENTS

| | | | | |
|---|---|---|---|---|
| 6,960,103 | B2 * | 11/2005 | Tokunaga | 439/607.13 |
| 6,971,916 | B2 * | 12/2005 | Tokunaga | 439/607.09 |
| 7,094,102 | B2 * | 8/2006 | Cohen et al. | 439/607.08 |
| 7,153,162 | B2 * | 12/2006 | Mizumura et al. | 439/607.11 |
| 7,467,955 | B2 * | 12/2008 | Raistrick et al. | 439/75 |
| 7,513,797 | B2 * | 4/2009 | Scherer et al. | 439/607.01 |
| 7,553,187 | B2 * | 6/2009 | Feldman et al. | 439/607.17 |
| 7,604,502 | B2 * | 10/2009 | Pan | 439/607.08 |
| 7,621,781 | B2 * | 11/2009 | Rothermel et al. | 439/607.05 |
| 7,927,144 | B2 * | 4/2011 | Feldman et al. | 439/607.05 |
| 8,025,531 | B1 * | 9/2011 | Zhang et al. | 439/607.05 |
| 8,047,874 | B2 * | 11/2011 | Ito | 439/607.1 |
| 8,167,651 | B2 * | 5/2012 | Glover et al. | 439/607.08 |
| 8,444,436 | B1 * | 5/2013 | Cohen et al. | 439/607.08 |
| 8,449,330 | B1 * | 5/2013 | Schroll et al. | 439/607.06 |
| 8,523,613 | B2 * | 9/2013 | Pan | 439/626 |
| 8,579,636 | B2 * | 11/2013 | Davis et al. | 439/65 |
| 8,641,448 | B2 * | 2/2014 | Lappoehn | 439/607.09 |
| 8,821,188 | B2 * | 9/2014 | Chang et al. | 439/607.01 |
| 8,840,431 | B2 * | 9/2014 | Nguyen et al. | 439/607.34 |
| 8,905,786 | B2 * | 12/2014 | Davis et al. | 439/607.1 |
| 2003/0022555 | A1 * | 1/2003 | Vicich et al. | 439/608 |
| 2010/0244872 | A1 | 9/2010 | Yoshida et al. | |
| 2012/0220169 | A1 * | 8/2012 | Uozumi et al. | 439/660 |
| 2013/0303005 | A1 * | 11/2013 | Chiba et al. | 439/108 |
| 2013/0323969 | A1 * | 12/2013 | Uozumi et al. | 439/607.01 |
| 2015/0064984 | A1 * | 3/2015 | Chiba et al. | 439/700 |

* cited by examiner

SOCKET FOR ELECTRONIC COMPONENTS

CLAIM OF PRIORITY

This application claims benefit of priority of Japanese Patent Application No. 2012-125683 filed on Jun. 1, 2012, which is hereby incorporated by reference in its entirety.

FIELD OF THE DISCLOSURE

The present disclosure relates to a socket for electronic components, and more particularly, to a socket for electronic components capable of coping with electronic components where electrode terminals are arranged at intersections of a rhombic lattice and being manufactured at a lower cost.

DESCRIPTION OF THE RELATED ART

In recent years, particularly, MPUs (Micro Processing Unit) where electrode terminals are arranged at the positions of intersections of a rhombic lattice have been developed for easy wiring in the MPU. Accordingly, there is a demand for sockets for electronic components that copes with the MPU having this terminal arrangement. Sockets for electronic components disclosed in Japanese Unexamined Patent Application Publication No. 2010-237133 and U.S. Pat. No. 6,877,223 are known as the above mentioned sockets for electronic components.

The sockets for electronic components disclosed in Japanese Unexamined Patent Application Publication No. 2010-237133 and U.S. Pat. No. 6,877,223 will be described below with reference to FIGS. 12 and 13. FIG. 12 is a view showing the structure of a socket SO1 for electronic components disclosed in Japanese Unexamined Patent Application Publication No. 2010-237133. FIG. 13 is a view showing the structure of a socket SO2 for electronic components disclosed in U.S. Pat. No. 6,877,223.

The socket SO1 for electronic components disclosed in Japanese Unexamined Patent Application Publication No. 2010-237133 is formed by forming through holes HO in a metal block BL and embedding contact probes CP into the through holes HO as shown in FIG. 12. Since the through holes HO are formed at the positions corresponding to the arrangement of electrode terminals of an electronic component, the socket can also cope with the electronic components where electrode terminals are arranged at the intersections of a rhombic lattice.

The socket SO2 for electronic components disclosed in U.S. Pat. No. 6,877,223 has a structure where electrode terminals TR are provided at the intersections of a rhombic lattice and the periphery of the respective electrode terminals TR is covered with a shield plate assembly ST where shield plates SB formed of metal plates are combined with each other in the form of a rhombic lattice as shown in FIG. 13.

The socket SO1 for electronic components disclosed in Japanese Unexamined Patent Application Publication No. 2010-237133 and the socket SO2 for electronic components disclosed in U.S. Pat. No. 6,877,223 can cope with electronic components where electrode terminals are arranged at the intersections of a rhombic lattice. However, as for the socket SO1 for electronic components, holes need to be formed so as to correspond to the number of the contact probes CP to be embedded into the metal block BL and the contact probes CP need to be inserted into the respective through holes HO one by one. For this reason, assembly costs are apt to increase. Further, since the contact probe CP itself is also expensive, it is difficult to cope with the reduction in cost. Furthermore, as for the socket SO2 for electronic components, the shield plate assembly ST is formed by combining the shield plates SB in the form of a rhombic lattice. However, when electrode terminals TR are to be disposed in rectangular regions as shown in FIG. 13, various kinds of shield plates SB having different lengths are needed. Since thirteen kinds of shield plates SB, which include shield plates from the shortest shield plate SB1 to the longest shield plate SB13, are needed in, for example, the socket SO2 for electronic components shown in FIG. 13, the costs of components are apt to increase. For this reason, it is difficult to obtain a reduction in costs.

SUMMARY

A socket for electronic components includes a shield plate assembly that is formed by combining a plurality of first shield plates with a plurality of second shield plates in the form of a lattice and has conductivity. Contact units, which are electrically connected to electrode terminals of electronic components, are disposed in openings of the lattice of the shield plate assembly so that the electrode terminals of the electronic components are electrically connected to the wiring of a wiring board. The shield plate assembly is formed in a shape where a plurality of lines where quadrilateral openings of the lattice are lined up in a first direction are arranged side by side in a second direction orthogonal to the first direction, and the openings of the adjacent lines are formed so as to be shifted relative to the openings of the next lines in the first direction by a half of the length of the side of the opening that extends in the first direction.

DESCRIPTION OF THE EXEMPLARY EMBODIMENTS

First Embodiment

A socket 100 for electronic components according to a first embodiment will be described below. First of all, the structure of the socket 100 for electronic components according to this embodiment will be described with reference to FIGS. 1 to 7.

Figure 1A:
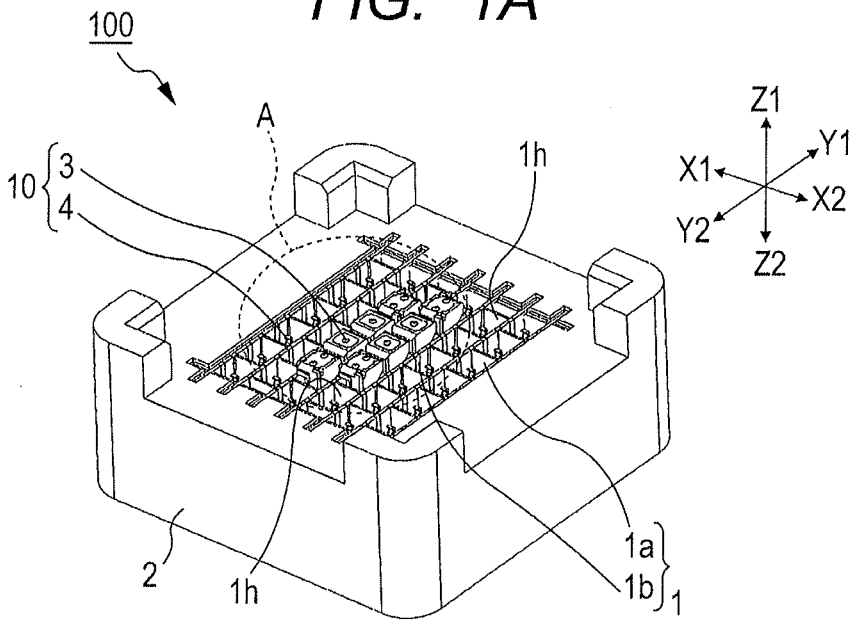
FIGS. 1A and 1B are views showing a socket 100 for electronic components.
Figure 1B:
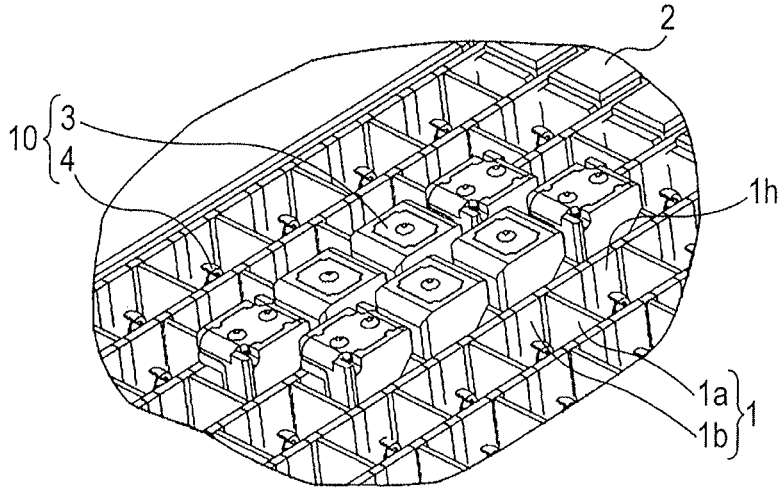
Figure 2:
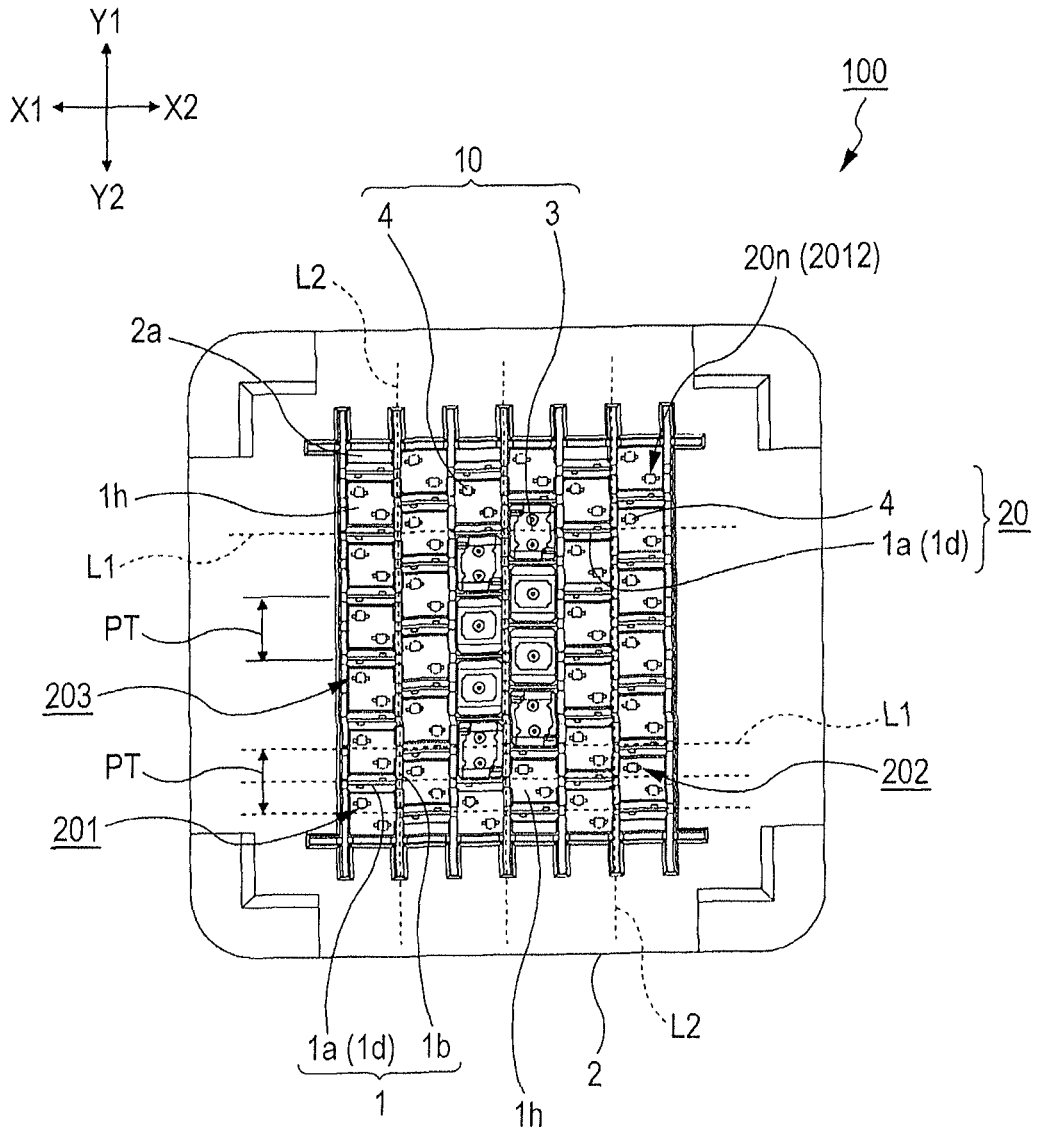
FIG. 2 is a plan view of the socket 100 for electronic components that is seen from a Z1 direction of FIG. 1A.
Figure 3A:
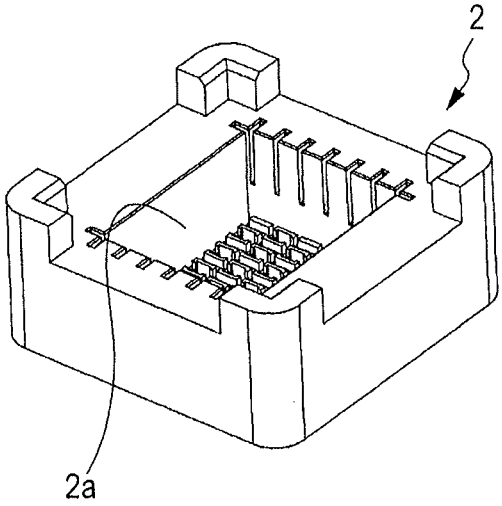
FIGS. 3A and 3B are views showing a case 2.
Figure 3B:
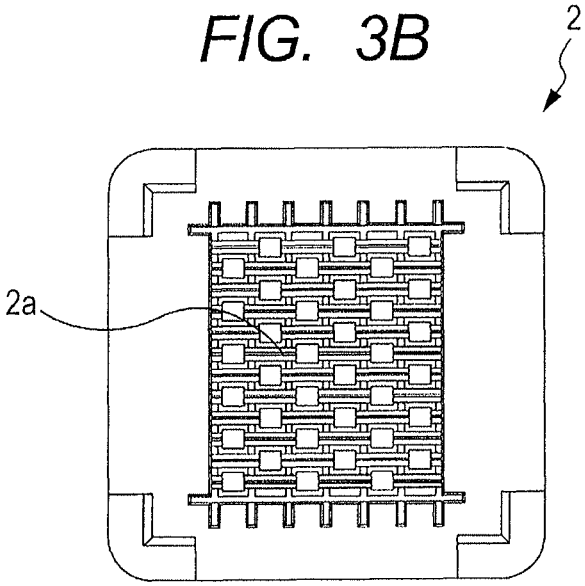
Figure 4A:
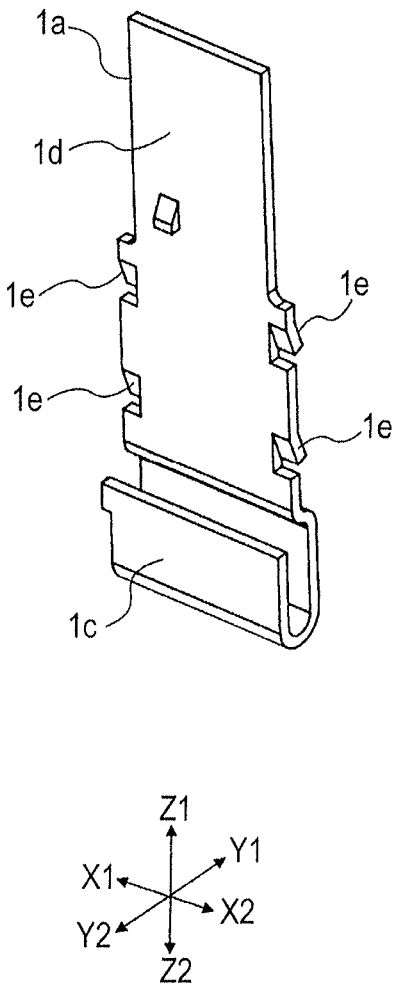
FIGS. 4A and 4B are views showing a first shield plate 1*a;*
Figure 4B:
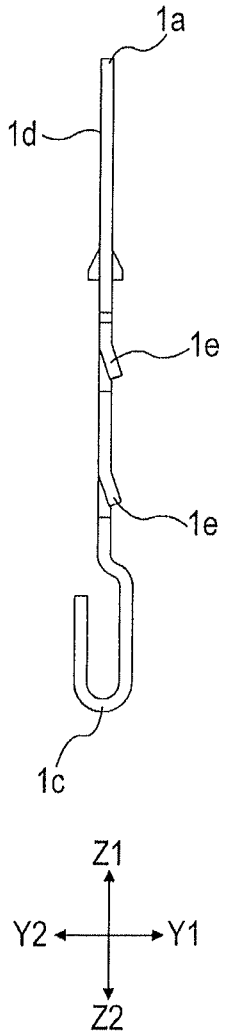
Figure 5:
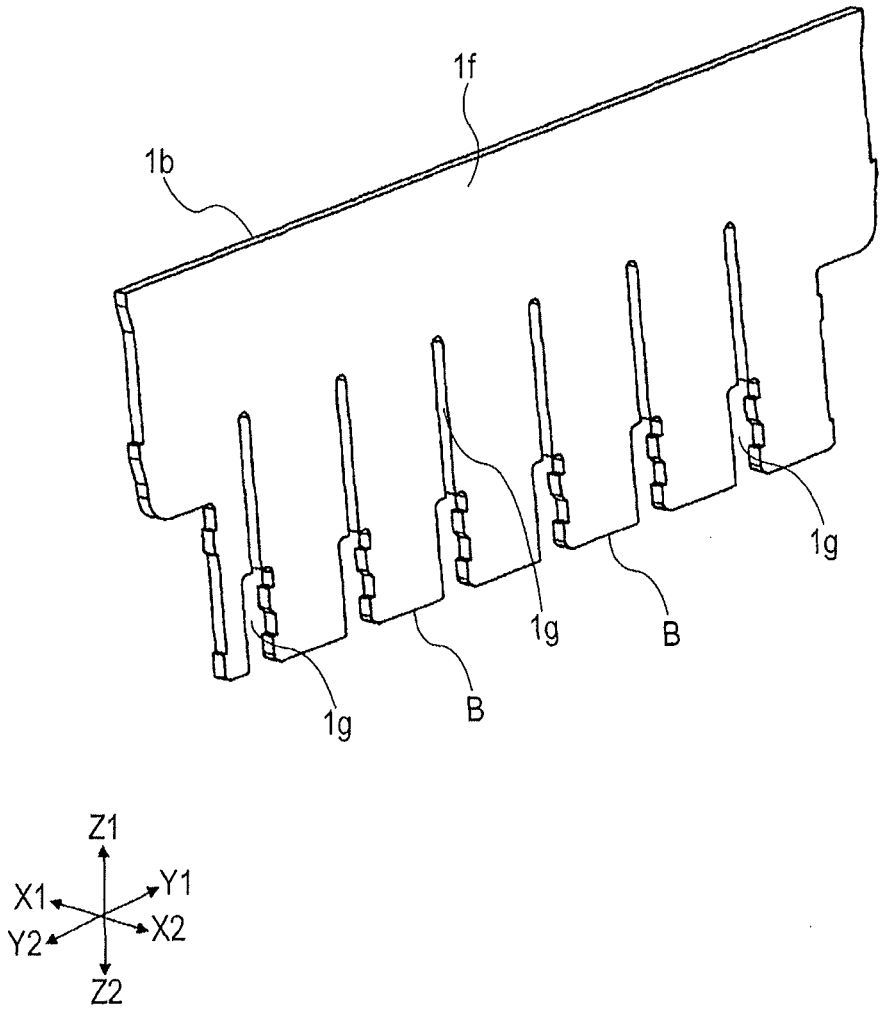
FIG. 5 is a perspective view showing the appearance of a second shield plate 1*b;*
Figure 6:
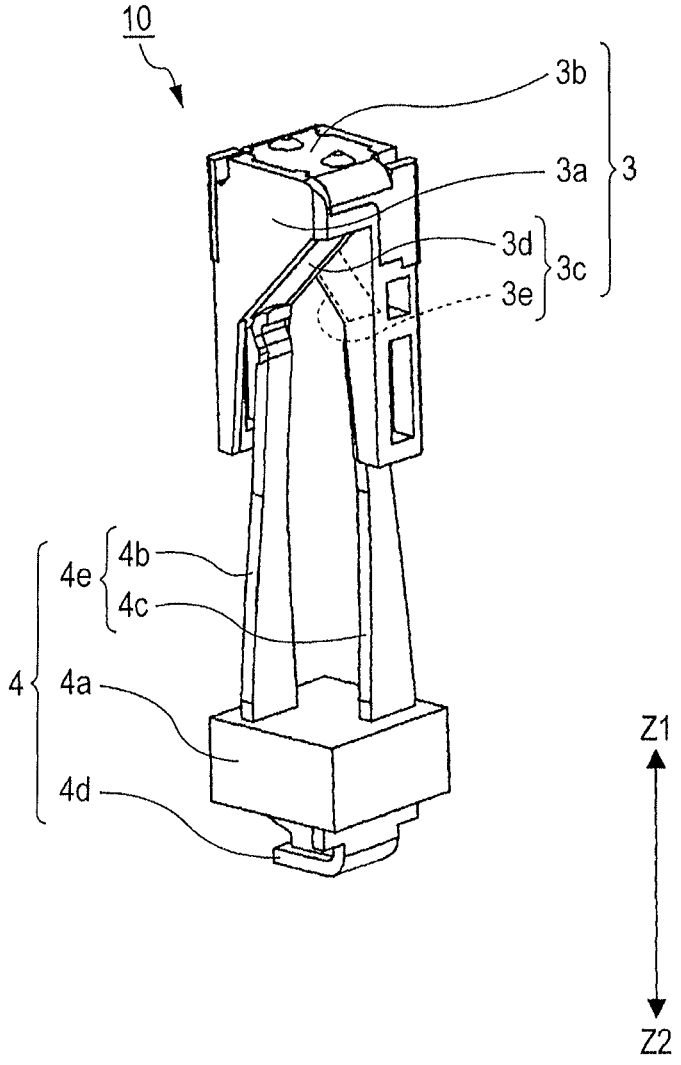
FIG. 6 is a perspective view showing the structure of a contact unit 10.
Figure 7A:
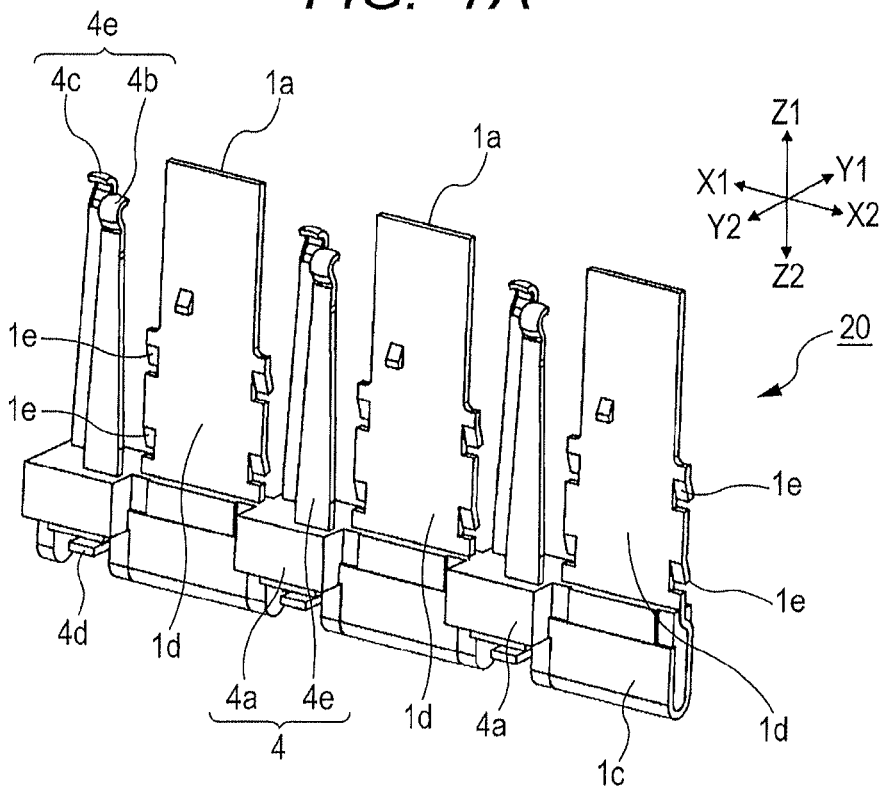
FIGS. 7A and 7B are views showing a contact bar 20.
Figure 7B:
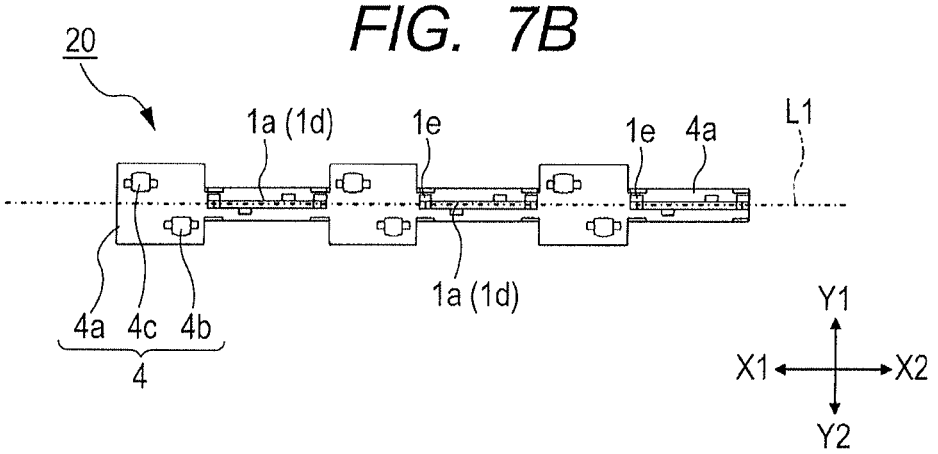

FIGS. 1A and 1B are views showing the socket 100 for electronic components, FIG. 1A is a perspective view showing the appearance of the socket 100 for electronic components, and FIG. 1B is an enlarged view of a portion A shown in FIG. 1A. FIG. 2 is a plan view of the socket 100 for electronic components that is seen from a Z1 direction of FIG. 1A. Meanwhile, only a part of moving members 3 are shown in FIGS. 1A, 1B and 2 for the purpose of easy illustration. FIGS. 3A and 3B are views showing a case 2, FIG. 3A is a perspective view showing the appearance of the case 2, and FIG. 3B is a plan view of the case 2 that is seen from above. FIGS. 4A and 4B are views showing a first shield plate 1*a*, FIG. 4A is a perspective view of the first shield plate 1*a*, and FIG. 4B is a plan view of the first shield plate 1*a* that is seen from an X2 direction shown in FIG. 4A. FIG. 5 is a perspective view showing the appearance of a second shield plate 1*b*. FIG. 6 is a perspective view showing the structure of a contact unit 10. Meanwhile, FIG. 6 shows only one contact unit 10 for the purpose of easy illustration. FIGS. 7A and 7B are views showing a contact bar 20, FIG. 7A is a perspective view of the contact bar 20, and FIG. 7B is a plan view of the contact bar 20 that is seen from the Z1 direction shown in FIG. 7A.

As shown in FIGS. 1A and 1B, the socket for electronic components includes a shield plate assembly 1 where a plurality of first shield plates 1*a* and a plurality of second shield plates 1*b* are combined with each other in the form of a lattice, contact units 10 that can be electrically connected to electrode terminals of electronic components, and a case 2 that holds the shield plate assembly 1 and the contact units 10. Further, each of the contact units 10 includes a moving member 3 that comes into contact with and can be electrically connected to an electrode terminal of an electronic component and an elastic member 4 that has conductivity and elasticity.

As shown in FIG. 3, the case 2 is made of a synthetic resin material and is formed in a rectangular parallelepiped shape. The case 2 includes a receiving portion 2*a* that can receive and hold the shield plate assembly 1 and the contact units 10. The receiving portion 2*a* is formed in the shape of a recess that is opened at the upper portion of the case 2 in a quadrilateral shape.

As shown in FIGS. 1A, 1B, and 2, the shield plate assembly 1 is formed by combining the plurality of first and second shield plates 1*a* and 1*b*, which are formed of metal plates, in the form of a lattice. The shield plate assembly 1 is formed in a shape where a plurality of lines where quadrilateral openings 1*h* of a lattice are lined up in a first direction that is a Y1-Y2 direction are arranged side by side in a second direction that is an X1-X2 direction orthogonal to the first direction. Further, the openings 1*h* of the adjacent lines are formed so as to be shifted relative to the openings 1*h* of the next lines in the first direction by a half of the length of the side of the opening 1*h* that extends in the first direction.

The first shield plate 1*a* is formed by bending a metal plate as shown in FIGS. 4A and 4B. An insertion portion 1*c*, which is inserted into a part of the receiving portion 2*a* of the case 2, is formed at one end of the first shield plate 1*a* by being bent so as to be folded. The first shield plate 1*a* includes a first wall portion 1*d*, which is formed in the shape of a flat plate and forms a part of the lattice of the shield plate assembly 1, at the other end thereof. Furthermore, the first shield plate 1*a* includes spring portions 1*e*, which are formed in the form of a leaf spring and can come into press contact with the second shield plate 1*b*, at both end portions of the first wall portion 1*d* in a width direction (an X1-X2 direction).

The second shield plate 1*b* is formed of a metal plate in the shape of a flat plate as shown in FIG. 5. The second shield plate 1*b* includes a second wall portion 1*f* that is formed in the shape of a flat plate and forms a part of the lattice of the shield plate assembly 1. A plurality of engaging portions 1*g*, which are formed in the shape of a cut, are formed at regular intervals at an end portion B of the second wall portion 1*f* that is disposed on the bottom in the receiving portion 2*a* when the shield plate assembly 1 is formed. Further, the width of the engaging portion 1*g* near the end portion B is larger than the width of the engaging portion 1*g* at the position that is separated from the end portion B by a predetermined distance. Furthermore, the length of the second shield plate 1*b* is set to be longer than the width of a portion of the receiving portion 2*a* of the case 2 where the second shield plate 1*b* is disposed, and is set to a length that the second shield plate 1*b* can be press-fitted when being disposed.

As shown in FIG. 6, the contact unit 10 includes the moving member 3 and the elastic member 4. The moving member 3 is formed of a synthetic resin material and a metal plate in a substantially rectangular parallelepiped shape, and can come into contact with and be electrically connected to an electrode terminal of an electronic component. The moving member 3 includes a pedestal portion 3*a* that is made of a synthetic resin material and is formed in a rectangular parallelepiped shape, a contact 3*b* that is formed of a metal plate and can come into contact with an electrode terminal of an electronic component, and a conductive portion 3*c* that is electrically connected to the contact 3*b*. The contact 3*b* is formed on the upper surface (the surface corresponding to the Z1 direction) of the pedestal portion 3*a*, and the conductive portion 3*c* is formed on the lower surface (the surface corresponding to a Z2 direction) of the pedestal portion 3*a*. The conductive portion 3*c* includes a first inclined portion 3*d* that includes a surface inclined toward one side with respect to a moving direction (Z1-Z2 direction) of the moving member 3, and a second inclined portion 3*e* that includes a surface inclined toward the other side with respect to the moving direction (Z1-Z2 direction) of the moving member 3.

The elastic member 4 includes a base portion 4*a* that is made of a synthetic resin material and is formed in a rectangular parallelepiped shape; first and second elastic portions 4*b* and 4*c* that are formed of metal plates, have conductivity and elasticity, and are formed in the form of a leaf spring extending from the upper surface (the surface corresponding to the Z1 direction) of the base portion 4*a* in the moving direction (Z1-Z2 direction) of the moving member 3; and a contact portion 4*d* that is formed of a metal plate, is formed so as to protrude from the lower surface (the surface corresponding to the Z2 direction) of the base portion 4*a*, and can come into contact with the wiring of a wiring board (not shown). The first and second elastic portions 4*b* and 4*c* are electrically connected to the contact portion 4*d*.

The shield plate assembly 1 and the contact units 10 have been separately described as separate components. However, in this embodiment, the elastic members 4 and the first shield plates 1*a* are used in the form of a contact bar 20 that is a unit component where the elastic members 4 and the first shield plates 1*a* are integrated with each other as shown in FIGS. 7A and 7B. The contact bar 20 is formed by alternately arranging the elastic members 4 and the first shield plates 1*a* in a line at a predetermined interval. Meanwhile, the contact bar 20 is formed so that elastic portions 4*e* including the first and second elastic portions 4*b* and 4*c* and the first shield plates 1*a* protrude in the Z1 direction from the base portions 4*a* of the elastic members 4 extend in one direction (X1-X2 direction). Further, the contact portion 4*d* is formed at a position that is opposite to the elastic portion 4*e* with the base portion 4*a* interposed therebetween, and the insertion portion 1*c* of the first shield plate 1*a* is formed at a position that is opposite to the first wall portion 1*d* of the first shield plate 1*a* with the base portion 4*a* interposed therebetween. In the plan view of the base portion 4*a* that is seen from the Z1 direction, the width of a portion of the base portion 4*a*, on which the elastic portion 4*e* is disposed, in the Y1-Y2 direction is larger than the width of a portion where the first shield plate 1*a* is disposed.

A state where the elastic portions 4*e* and the first shield plates 1*a* of the contact bar 20 are disposed will be described below with reference to FIG. 7B. Meanwhile, an imaginary straight line L1 shown in FIG. 7B is a straight line that is parallel to the X1-X2 direction shown in FIG. 7A. As shown in FIG. 7B, the first shield plates 1*a* are disposed so that the first wall portions 1*d* serving as the inner walls of the lattice of the shield plate assembly 1 are parallel to the imaginary straight line L1. In this case, the first and second elastic portions 4*b* and 4*c* are disposed at different positions that are arranged along the imaginary straight line L1 with the imaginary straight line L1 interposed therebetween. Each of the first elastic portions 4*b* is disposed on one side, which corresponds to the Y2 direction, of the imaginary straight line L1 and on one side corresponding to the X2 direction along the imaginary straight line L1; and each of the second elastic portions 4*c* is disposed on the other side, which corresponds to the Y1 direction, of the imaginary straight line L1 and on the other side corresponding to the X1 direction along the imaginary straight line L1. Meanwhile, a distance between the first elastic portion 4*b* and the imaginary straight line L1 is the same as a distance between the second elastic portion 4*c* and the imaginary straight line L1.

Figure 8A:
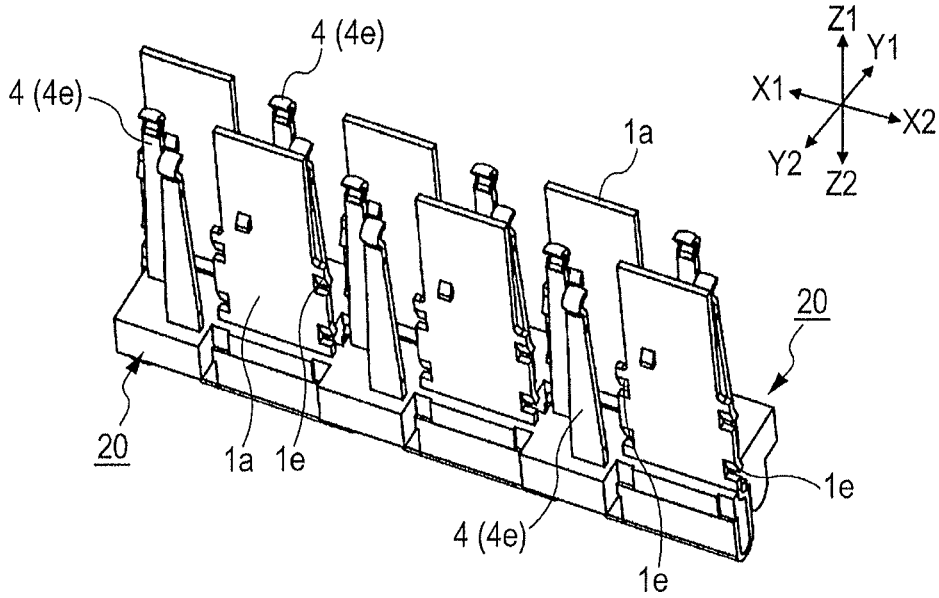
FIGS. 8A and 8B are views showing a state where the contact bars 20 are disposed.
Figure 8B:
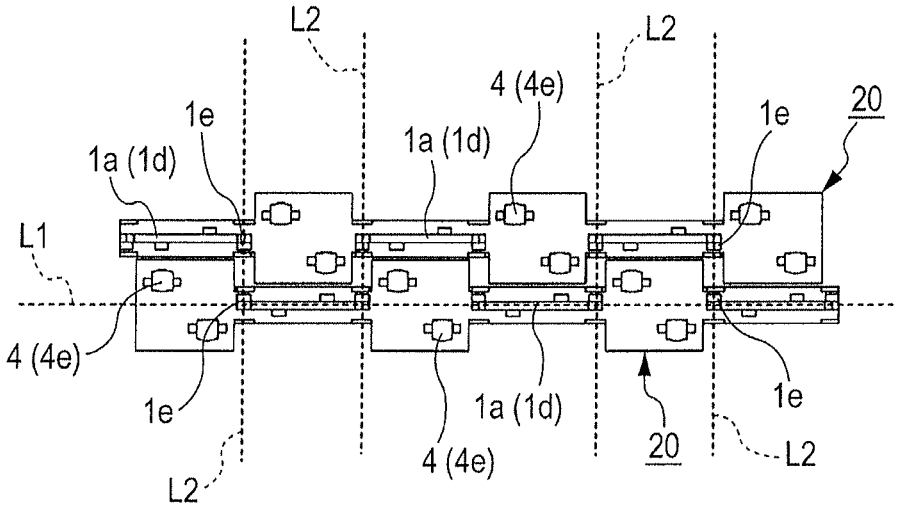
Figure 9A:
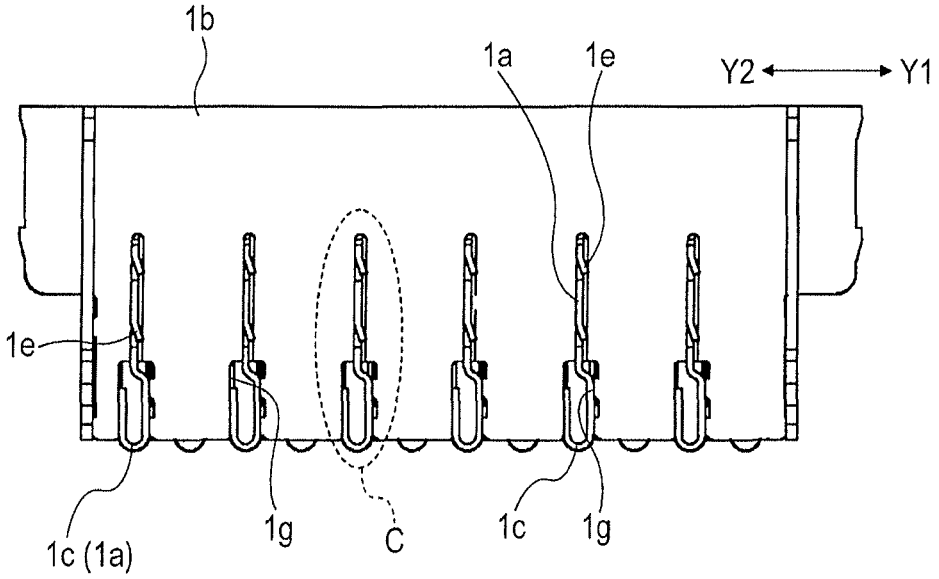
FIGS. 9A and 9B are side views showing a state where spring portions 1*e* are engaged with engaging portions 1*g;*
Figure 9B:
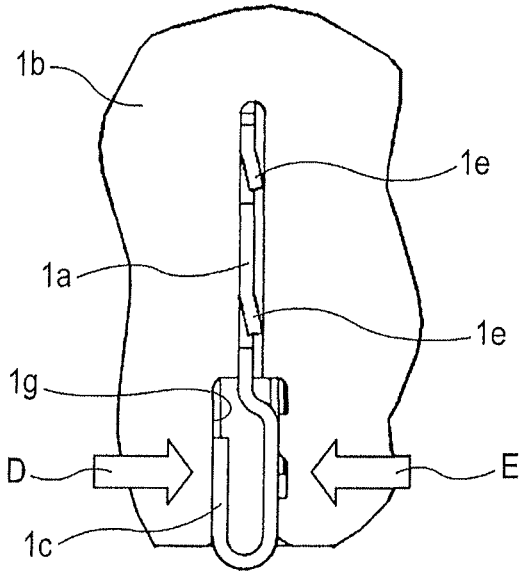

Next, the structure of the socket 100 for electronic components will be described with reference to FIGS. 2, 6, 8, and 9. FIGS. 8A and 8B are views showing a state where the contact bars 20 are disposed, FIG. 8A is a perspective view showing the state where the contact bars 20 are disposed, and FIG. 8B is a plan view showing the state where the contact bars 20 are disposed that is seen from the Z1 direction of FIG. 8A. Meanwhile, FIGS. 8A and 8B show only a pair of contact bars 20 for the purpose of easy illustration. FIGS. 9A and 9B are views showing a state where the spring portions 1*e* are engaged with the engaging portions 1*g*, FIG. 9A is a side view showing the state where the spring portions 1*e* are engaged with the engaging portions 1*g*, and FIG. 9B is an enlarged view of a portion C shown in FIG. 9A. Meanwhile, the case 2 is not shown in FIGS. 9A and 9B for the purpose of easy illustration.

As shown in FIG. 2, the elastic members 4 and the first shield plates 1*a* are disposed in the receiving portion 2*a* of the case 2 in the form of the contact bar 20. In this case, the plurality of contact bars 20 are arranged side by side in the Y1-Y2 direction, which is the first direction, at regular intervals so that the longitudinal directions of the contact bars are parallel to the X1-X2 direction that is the second direction. Further, the regular interval is a half of the length PT of the side of the opening 1*h* that extends in the first direction, and the contact bars 20 are disposed side by side from the first line to the (n)th line (n is 2 or more) so as to form a plurality of lines in the Y1-Y2 direction that is the first direction orthogonal to the X1-X2 direction. In this case, as shown in FIG. 8B, a pair of contact bars 20, which are disposed on the (n−1)th line and the (n)th line and are adjacent to each other, are arranged side by side so that the contact bars 20 are shifted relative to each other in the X1-X2 direction by a predetermined interval that is an interval between the disposed elastic portions 4*e* and an interval between the disposed first shield plates 1*a* and the first shield plates 1*a* of one contact bar 20 are adjacent to the elastic members 4 of the other contact bar 20. Furthermore, the contact bars 20 are disposed so that the spring portions 1*e* of the first shield plates 1*a* are arranged side by side on imaginary straight lines L2 orthogonal to the imaginary straight line L1.

As shown in FIG. 2, the second shield plates 1*b* are disposed along the imaginary straight lines L2 in the receiving portion 2*a* so as to be orthogonal to the first shield plates 1*a*. Accordingly, the plurality of second shield plates 1*b* are disposed so that both ends of the first shield plates 1*a* in the X1-X2 direction, which is the second direction, are interposed between the second shield plates 1*b*. As a result, the lattice of the shield plate assembly 1 is formed. The lattice of the shield plate assembly 1 forms lines in the Y1-Y2 direction that is the first direction and is formed from the first line to the (p)th line (p is 2 or more). Further, the lattice of the adjacent lines is formed so as to be shifted relative to the lattice of the next lines in the first direction by a half of the length PT of the side of the opening 1*h* that extends in the direction of the line.

Moreover, when the second shield plates 1*b* are held in the receiving portion 2*a* of the case 2, the second shield plates 1*b* are held so that a part of the first shield plate 1*a* are inserted into the engaging portions 1*g* of the second shield plate 1*b* as shown in FIG. 9A. Further, when the second shield plates 1*b* are disposed in the receiving portion 2*a*, the length of the second shield plate 1*b* is set to be longer than the width of a portion of the receiving portion 2*a* of the case 2 where the second shield plate 1*b* is disposed, and is set to a length that the second shield plate 1*b* can be press-fitted when being disposed. Accordingly, the second shield plates 1*b* are pressed in the Y1 direction and the Y2 direction. In this case, the engaging portion 1*g* is bent in the directions of arrows D and E shown in FIG. 9B, is abutted against the spring portions 1*e* and the insertion portion 1*c*, and comes into press contact with the spring portions 1*e* and the insertion portion 1*c* while bending the spring portions 1*e* and the insertion portion 1*c*. Accordingly, the first and second shield plates 1*a* and 1*b* are electrically connected to each other.

The moving members 3 are disposed in the openings 1*h* of the shield plate assembly 1 formed by the first and second shield plates 1*a* and 1*b* so that the conductive portion 3*c* is oriented in the direction where the conductive portion 3*c* comes into contact with the first and second elastic portions 4*b* and 4*c* as shown in FIG. 6. Accordingly, the contact units 10 are formed in the lattice of the shield plate assembly 1. The moving member 3 is disposed at the end portion of the elastic portion 4*e* of the elastic member 4 so as to be electrically connected to the elastic member 4. Therefore, as the moving member 3 comes into contact with an electrode terminal of an electronic component, the moving member 3 can be moved against the elasticity of the elastic portion 4*e* of the elastic member 4 in the direction where the moving member 3 is pressed. The socket 100 for electronic components is formed in this way.

Figure 10A:
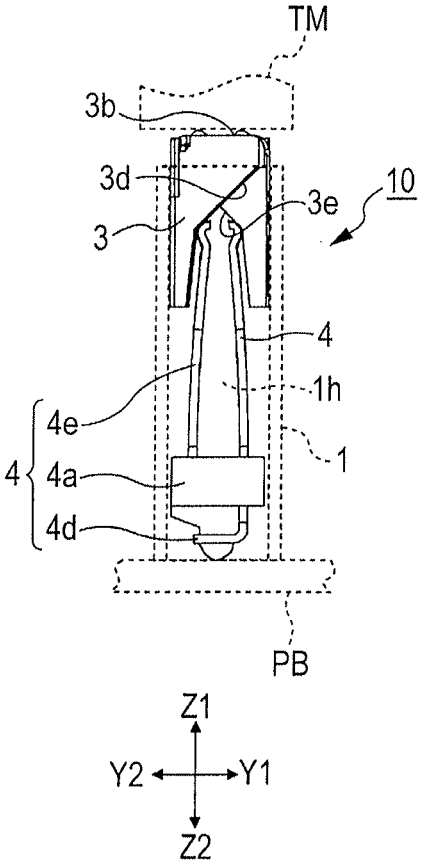
FIGS. 10A and 10B are side views illustrating the operation of the socket 100 for electronic components.
Figure 10B:
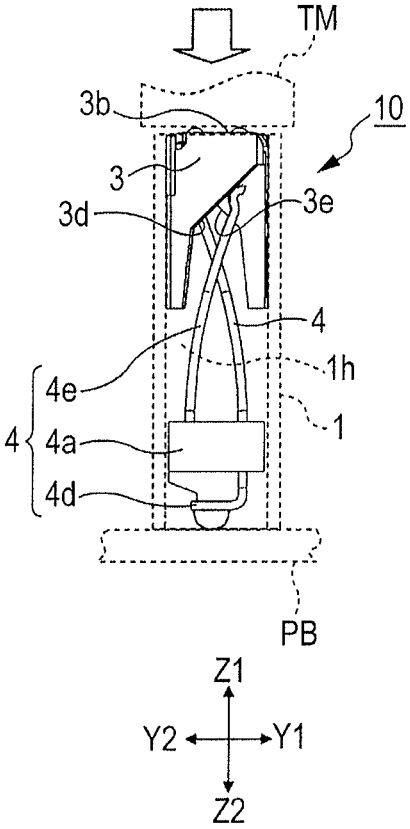

Next, the operation of the socket 100 for electronic components will be described with reference to FIG. 10. FIGS. 10A and 10B are side views illustrating the operation of the socket 100 for electronic components, FIG. 10A is a side view showing the socket 100 for electronic components that is in an initial state, and FIG. 10B is a side view showing the socket 100 for electronic components that has operated. Meanwhile, FIGS. 10A and 10B shows the operation of only the contact unit 10 that is provided in an arbitrary opening 1*h* for the purpose of easy illustration.

The socket 100 for electronic components is used to electrically connect electronic components to a wiring board. The socket 100 for electronic components is used while being electrically connected to and held on a wiring board PB by soldering or the like. When electronic components (not shown) are inserted into the socket 100 for electronic components from the Z1 direction shown in FIG. 1A, electrode terminals TM of the electronic components come into contact with the contacts 3*b* of the moving members 3. After that, with the insertion of the electronic components, the moving members 3 are moved against the elastic forces of the elastic portions 4*e* of the elastic members 4 in an insertion direction of the electronic component (Z2 direction). When the moving member 3 is pressed against the elastic force of the elastic portion 4*e* of the elastic member 4, the elastic portion 4*e* is bent and comes into press contact with the first and second inclined portions 3*d* and 3*e*. Accordingly, the electrical connection between the electrode terminal of the electronic component and the contact 3*b* of the moving member 3 becomes stable and the electrical connection between the conductive portion 3*c* of the moving member 3 and the elastic portion 4*e* of the elastic member 4 becomes stable. Therefore, it is possible to electrically connect electronic components to a wiring board by the socket 100 for electronic components.

An effect of this embodiment will be described below.

The socket 100 for electronic components according to this embodiment is adapted as follows: the socket 100 includes the shield plate assembly 1 that is formed by combining the plurality of first shield plates 1*a* with the plurality of second shield plates 1*b* in the form of a lattice and has conductivity; the contact units 10, which can be electrically connected to electrode terminals of electronic components, are disposed in the openings 1*h* of the lattice of the shield plate assembly 1 so that the electrode terminals of the electronic components can be electrically connected to the wiring of a wiring board; the shield plate assembly 1 is formed in a shape where a plurality of lines where the quadrilateral openings 1*h* of the lattice are lined up in the first direction that is the Y1-Y2 direction are arranged side by side in the second direction that is the X1-X2 direction orthogonal to the first direction; and the openings 1*h* of the adjacent lines are formed so as to be shifted relative to the openings 1*h* of the next lines in the first direction by a half of the length of the side of the opening 1*h* that extends in the first direction.

Accordingly, the openings 1*h* of the lattice of the adjacent lines of the lines of the lattice of the shield plate assembly 1 are formed so as to be shifted relative to the openings 1*h* of the lattice of the next lines in the first direction by a half of the length PT of the side of the opening 1*h* that extends in the first direction. For this reason, since the electronic component and the moving member are electrically connected to each other near the position of the center of gravity of the opening 1*h* in the plan view of the opening 1*h*, it is possible to obtain an effect of coping with the electrical connection to electronic components where electrode terminals are arranged at the positions of intersections of a rhombic lattice.

Further, if the shape of the lattice of the shield plate assembly 1 is a rhombic shape as in the related art disclosed in U.S. Pat. No. 6,877,223, various kinds of shield plates having different lengths are needed. In contrast, since the kinds of the shield plates of the shield plate assembly 1 are reduced (two kinds of shield plates), the structure of the socket becomes simple. Accordingly, it is possible to obtain an effect of providing a socket for electronic components that can be manufactured at a low cost.

Furthermore, the socket 100 for electronic components according to this embodiment is adapted as follows: each of the contact units 10 includes the moving member 3 that comes into contact with and can be electrically connected to an electrode terminal of an electronic component and the elastic member 4 that has conductivity and elasticity; the contact bars 20 are formed by alternately arranging the elastic members 4 and the first shield plates 1*a* in a line at a predetermined interval; the plurality of contact bars 20 are arranged side by side in the first direction at regular intervals so that the longitudinal directions of the contact bars are parallel to the second direction; the regular interval is set to a half of the length PT of the side of the opening 1*h* that extends in the first direction; the plurality of second shield plates 1*b* are disposed so that both ends of the first shield plates 1*a* in the second direction are interposed between the second shield plates 1*b*, thereby forming the lattice of the shield plate assembly; and the moving members 3 are disposed in the openings 1*h* of the shield plate assembly 1, so that the contact units 10 are formed in the lattice.

Accordingly, since the contact bar 20, which is obtained by forming the plurality of elastic members 4 and the plurality of first shield plates 1*a* in the form of a unit, is used, the structure of the socket becomes simpler and the socket is easily assembled. As a result, it is possible to obtain an effect of providing a socket for electronic components that can be manufactured at a lower cost.

Moreover, the socket 100 for electronic components according to this embodiment is adapted as follows: the contact bar 20 includes the elastic members 4 and the base portions 4*a* holding the first shield plates 1*a*; and the elastic members 4 and the first shield plates 1*a* are formed so as to protrude from the base portions 4*a* in the same direction.

Accordingly, since the contact bar 20 (the contact units 10) is formed using the elastic portions 4*e* having elasticity, electrical connection is made while biasing electronic components. Therefore, it is possible to obtain a more stable electrical connection. Further, since the contact bar 20 (the contact units 10) is formed using the elastic portions 4*e* having elasticity, it is possible to absorb an impact generated when the electronic component comes into contact with the contact bar 20 (the contact unit 10). Accordingly, it is possible to obtain an effect of preventing the breakage of an electrode of an electronic component and the contact bar 20 (the contact unit 10).

Furthermore, the socket 100 for electronic components according to this embodiment is adapted as follows: the moving member 3 is disposed at the end portion of the elastic member 4 so as to be electrically connected to the elastic member 4, and is moved against the elasticity of the elastic member 4 when being pressed by coming into contact with an electrode terminal of an electronic component.

Accordingly, since the moving member 3 is disposed at the end portion of the elastic member 4 so as to be electrically connected to the elastic member 4 and is adapted to be moved against the elasticity of the elastic member 4 when being pressed, the moving member 3 and the elastic member 4 come into press contact with each other. Therefore, it is possible to obtain an effect of further stabilizing the electrical connection between the moving member 3 and the elastic member 4.

Figure 11:
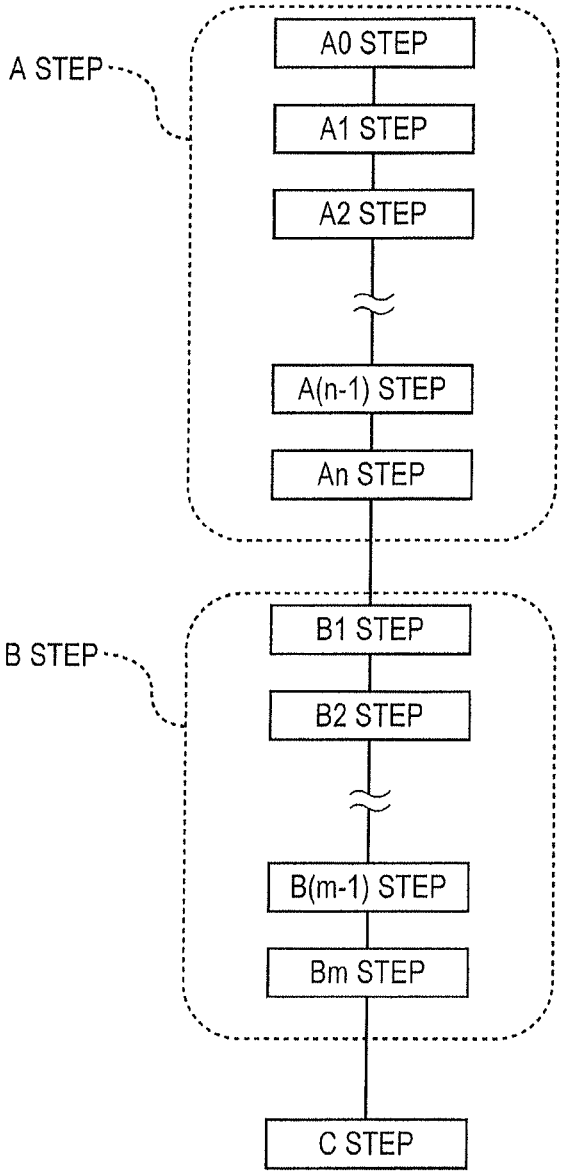
FIG. 11 is a view illustrating a flow of steps of a method of manufacturing the socket 100 for electronic components.
Figure 12:
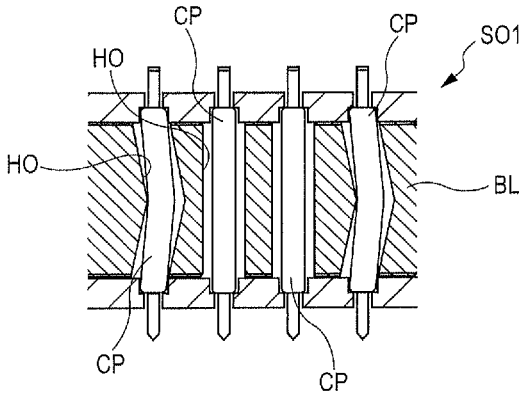
PRIOR ART FIG. 12
FIG. 12 is a view showing the structure of a socket SO1 for electronic components disclosed in Japanese Unexamined Patent Application Publication No. 2010-237133.
Figure 13:
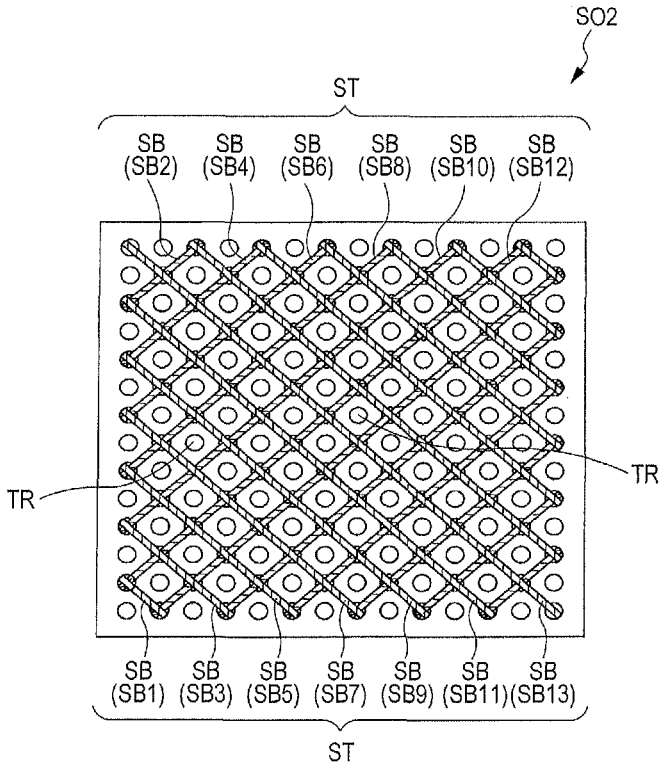
PRIOR ART FIG. 13
FIG. 13 is a view showing the structure of a socket SO2 for electronic components disclosed in U.S. Pat. No. 6,877,223.

Second Embodiment method of manufacturing the socket 100 for electronic components, which has been described as the first embodiment, will be described with reference to FIGS. 2, 9, and 11. FIG. 11 is a view illustrating a flow of steps of the method of manufacturing the socket 100 for electronic components.

As shown in FIG. 11, the assembly of the socket 100 for electronic components includes A step, B step, and C step. B step is performed after A step, and C step is then performed. Meanwhile, A step includes A0 step and A1 to An steps (n is 2 or more). A0 to An steps are sequentially performed in this order. Further, B step includes B1 to Bm steps (m is 2 or more), and B1 to Bm steps are sequentially performed in this order.

A step is a step of forming the contact bars 20 and disposing the contact bars 20 in the receiving portion 2*a* of the case 2 in a second direction such as the X1-X2 direction shown in FIG. 2. A0 step is a step of forming a predetermined number of contact bars 20 where the elastic members 4 and the first shield plates 1*a* are alternately arranged in a line at a predetermined interval. Meanwhile, the socket 100 for electronic components shown in FIG. 2 requires twelve contact bars 20.

A1 step is a step of disposing a first contact bar 201 among the contact bars 20 so that the longitudinal direction of the first contact bar 201 is parallel to the second direction. For example, as shown in FIG. 2, the first contact bar 201 is disposed along the inner surface of the receiving portion 2*a* corresponding to the Y2 direction.

A2 step is a step of disposing a second contact bar 202 among the contact bars 20 so that the longitudinal direction of the second contact bar 202 is parallel to the second direction and the second contact bar 202 is separated from the first contact bar 201 by a half of the length PT of the side of the opening 1*h* extending in the first direction and is shifted relative to the first contact bar 201 toward one side in the second direction by the predetermined interval. In the socket 100 for electronic components shown in FIG. 2, the second contact bar 202 is separated from the first contact bar 201 in the Y1 direction and is disposed so as to be shifted relative to the first contact bar 201 toward one side in the second direction corresponding to the X2 direction by a predetermined interval.

A3 step is a step of disposing a third contact bar 203 among the contact bars 20 so that the longitudinal direction of the third contact bar 203 is parallel to the second direction and the third contact bar 203 is separated from the second contact bar 202 toward the side where the first contact bar 201 is not disposed by a half of the length PT of the side of the opening 1*h* extending in the first direction and is shifted relative to the second contact bar 202 toward the other side in the second direction by the predetermined interval.

The same steps as A1 to A3 steps are repeated predetermined n times (n is 2 or more), and An step is performed to dispose the (n)th contact bar 20*n* in the receiving portion 2*a*. Meanwhile, as for the socket 100 for electronic components shown in FIG. 2, steps are performed up to A12 step to dispose the twelfth contact bar 2012.

B step is a step of loading the plurality of second shield plates 1*b* onto the first to (n)th contact bars 201 to 20*n* disposed in the receiving portion 2*a* of the case 2 by A1 to An steps so that both ends of the first shield plates 1*a* in the first direction are interposed between the second shield plates 1*b*. B1 step is a step of disposing one second shield plate 1*b* in the first direction so that the second shield plate 1*b* comes into contact with any one end portion of any one first shield plate 1*a* in the first direction. In this case, the second shield plate 1*b* is held so that a part of the first shield plate 1*a* is inserted into the engaging portion 1*g* of the second shield plate 1*b* as shown in FIG. 9A. B2 step is a step of disposing one second shield plate 1*b* in the same manner as the B1 step at a position that is different from the position of B1 step. The same steps as B1 and B2 steps are performed up to Bm step in which the loading of a predetermined number of second shield plates 1*b* (m second shield plates 1*b*, m is 2 or more) is completed. When B step is completed, the second shield plates 1*b* are disposed so that both ends of the first shield plates 1*a* in the first direction are interposed between the second shield plates 1*b*. As a result, the shield plate assembly 1 is formed. Meanwhile, after, for example, a second shield plate 1*b* may be loaded in B1 step at a position where the second shield plate 1*b* can be loaded along the inner surface of the receiving portion 2*a* corresponding to the X1 direction, second shield plates 1*b* may be sequentially loaded in the X2 direction in the respective steps of B step at the positions where the second shield plates 1*b* can be loaded.

C step is a step of fitting the moving members 3 into the openings 1*h* of the lattice-like shield plate assembly 1 that is formed by A1 to An steps and B1 to Bm steps.

The assembly of the socket 100 for electronic components is performed by sequentially performing A step, B step, and C step.

An effect of this embodiment will be described below.

The method of manufacturing the socket 100 for electronic components according to this embodiment includes a step of sequentially performing A step of disposing the contact bars 20 in the receiving portion 2*a* of the case 2, B step of loading the second shield plates 1*b*, and C step of fitting the moving members 3 into the openings 1*h*.

Accordingly, since the elastic members 4 and the first shield plates 1*a* are formed in the form of a unit as the contact bars 20, it is possible to reduce the number of parts and to make an assembling step easy as compared to a case where the elastic members 4 and the first shield plates 1*a* are separately formed and are assembled. Therefore, productivity is improved, so that it is possible to obtain an effect of reducing production costs.

Further, since the contact bar 20 of this embodiment is formed by alternately arranging three elastic members 4 and three first shield plates 1*a* side by side, it is possible to dispose the contact bars so that the contact bars are shifted relative to each other toward one side in the second direction by a predetermined interval, by disposing the contact bars in parallel so that the orientation of the (n)th contact bar 20*n* is opposite to the orientation of the (n−1)th contact bar 20(*n*−1). As a result, it is possible to make an assembling step easy. Accordingly, productivity is improved, so that it is possible to obtain an effect of reducing production costs.

The socket 100 for electronic components and the method of manufacturing the socket 100 according to the embodiments of the invention have been specifically described above, but the invention is not limited to the above-mentioned embodiments and may be modified in various ways without departing from the scope of the invention. For example, the invention may have the following embodiments and these embodiments are also included in the scope of the invention.

(1) In the first embodiment, the contact unit 10 has included the moving member 3 and the elastic member 4. However, the moving member 3 and the elastic member 4 may be integrated with each other, and the elastic portion 4*e* of the elastic member 4 may not be formed in the form of a leaf spring and may be formed of other biasing members.

(2) In the first embodiment, the contact bar 20 has been formed by arranging three sets of the combination of the elastic member 4 and the first shield plate 1*a* side by side. However, the contact bar 20 may be appropriately modified according to the size or the like of the socket 100 for electronic components.

(3) In the second embodiment, the second shield plates 1*b* have been sequentially disposed in the respective steps of B step from any one side in the first direction at the positions where the second shield plates 1*b* can be disposed. However, the second shield plates 1*b* may be disposed from any position as long as there is no trouble in the assembly.

It should be understood by those skilled in the art that various modifications, combinations, sub-combinations and alterations may occur depending on design requirements and other factors insofar as they are within the scope of the appended claims of the equivalents thereof.

What is claimed is:

1. A socket for electronic components including;

a shield plate assembly comprising a plurality of first shield plates and a plurality of second shield plates in the form of a lattice and having conductivity, and contact units, which are electrically connected to electrode terminals of electronic components, being disposed in openings of the lattice of the shield plate assembly so that the electrode terminals of the electronic components are electrically connected to the wiring of a wiring board, wherein the shield plate assembly has a shape where a plurality of lines where quadrilateral openings of the lattice are lined up in a first direction are arranged side by side in a second direction orthogonal to the first direction, and the openings of the adjacent lines are arranged so as to be shifted relative to the openings of the next lines in the first direction by a half of the length of the side of the opening that extends in the first direction;

wherein the contact unit includes a moving member that comes into contact with and is electrically connected to the electrode terminal of the electronic component and an elastic member that has conductivity and elasticity, contact bars are formed by alternately arranging the elastic members and the first shield plates in a line at a predetermined interval, the plurality of contact bars are arranged side by side in the first direction at regular intervals so that longitudinal directions of the contact bars are parallel to the second direction, the regular interval is set to a half of the length of the side of the opening that extends in the first direction, the plurality of second shield plates are disposed so that both ends of the first shield plates in the second direction are interposed between the second shield plates, thereby forming the lattice of the shield plate assembly, and the moving members are disposed in the openings of the shield plate assembly, so that the contact units are formed in the lattice.

2. The socket for electronic components according to claim 1, wherein the contact bar includes the elastic members and base portions holding the first shield plates, and the elastic members and the first shield plates are arranged so as to protrude from the base portions in the same direction.

3. The socket for electronic components according to claim 1, wherein the moving member is disposed at an end portion of the elastic member so as to be electrically connected to the elastic member, and is moved against the elasticity of the elastic member when being pressed by coming into contact with the electrode terminal of the electronic component.

4. A method of manufacturing a socket for electronic components, the socket for electronic components including a shield plate assembly where a plurality of first shield plates and a plurality of second shield plates are combined with each other in the form of a lattice, contact units, which are electrically connected to electrode terminals of electronic components, being disposed in openings of the lattice of the shield plate assembly so that the electrode terminals of the electronic components are electrically connected to the wiring of a wiring board, the shield plate assembly being formed in a shape where a plurality of lines where quadrilateral openings of the lattice are lined up in a first direction are arranged side by side in a second direction orthogonal to the first direction, and the openings of the adjacent lines being formed so as to be shifted relative to the openings of the next lines in the first direction by a half of the length of the side of the opening that extends in the first direction, the method comprising:

A0) forming a predetermined number of contact bars where elastic members and the first shield plates are alternately arranged in a line at a predetermined interval;

A1) disposing a first contact bar among the contact bars so that the longitudinal direction of the first contact bar is parallel to the second direction;

A2) disposing a second contact bar among the contact bars so that the longitudinal direction of the second contact bar is parallel to the second direction and the second contact bar is separated from the first contact bar by a half of the length of the side of the opening extending in the first direction and is shifted relative to the first contact bar toward one side in the second direction by the predetermined interval;

A3) disposing a third contact bar among the contact bars so that the longitudinal direction of the third contact bar is parallel to the second direction and the third contact bar is separated from the second contact bar toward a side where the first contact bar is not disposed by a half of the length of the side of the opening extending in the first direction and is shifted relative to the second contact bar toward the other side in the second direction by the predetermined interval;

disposing a (n)th contact bar by repeating the same steps as A1 to A3 predetermined n times (n is 2 or more);

B1 to Bm) sequentially loading a predetermined number of the second shield plates (m second shield plates, m is 2 or more) onto the first to (n)th contact bars disposed by the A1 to An steps so that both ends of the first shield plates in the second direction are interposed between the second shield plates; and C) fitting the moving members into the openings of the lattice-like shield plate assembly that is formed by A1 to An and B1 to Bm.

* * * * *